US005290142A

United States Patent [19]

Ispas et al.

[11] Patent Number: 5,290,142

[45] Date of Patent: Mar. 1, 1994

[54] METHOD OF MONITORING A PUMPING LIMIT OF A MULTISTAGE TURBOCOMPRESSOR WITH INTERMEDIATE COOLING

[75] Inventors: Ioan Ispas, Kön; Ulrich Grundmann, Voerde; Yvan Van Hoof, Kön, all of Fed. Rep. of Germany

[73] Assignee: Atlas Copco Energas GmbH, Cologne, Fed. Rep. of Germany

[21] Appl. No.: 952,964

[22] Filed: Sep. 29, 1992

[30] Foreign Application Priority Data

Oct. 1, 1991 [DE] Fed. Rep. of Germany ..... 4132735
Jan. 28, 1992 [DE] Fed. Rep. of Germany ..... 4202226

[51] Int. Cl.[5] ..... F04D 27/02

[52] U.S. Cl. ..... 415/1; 415/11; 415/15; 415/17; 415/27; 415/47

[58] Field of Search ..... 415/1, 11, 15, 17, 26, 415/27, 47; 417/253

[56] References Cited

U.S. PATENT DOCUMENTS

| | | | |
|---|---|---|---|
| 3,424,370 | 1/1969 | Law | 415/1 |
| 3,441,200 | 4/1969 | Huesgen | 415/47 |
| 4,288,198 | 9/1981 | Hibino et al. | 415/1 |
| 4,362,462 | 12/1982 | Blotenberg | 415/1 |
| 4,810,163 | 3/1989 | Blotenberg | 415/17 |
| 4,831,534 | 5/1989 | Blotenberg | 415/15 |
| 4,831,535 | 5/1989 | Blotenberg | 415/1 |
| 4,944,652 | 7/1990 | Blotenberg | 415/1 |

FOREIGN PATENT DOCUMENTS

| | | | |
|---|---|---|---|
| 235697 | 9/1988 | Japan | 415/17 |
| 964251 | 10/1982 | U.S.S.R. | 415/17 |
| 987193 | 1/1983 | U.S.S.R. | 415/17 |
| 1366713 | 1/1988 | U.S.S.R. | 415/1 |

*Primary Examiner*—Edward K. Look
*Assistant Examiner*—James A. Larson
*Attorney, Agent, or Firm*—Herbert Dubno

[57] ABSTRACT

A method of operating a multistage turbocompressor or of monitoring the pump limit thereof, whereby the pump limit function is stored in the control unit in the form $Y=m.F+b$ and the coefficients m and b are determined by the linear relationships $$m=m_0+m_1.dT_s+\Sigma m_{2i}.dT_{ri}$$

$$b=b_0+b_1.dT_s+\Sigma b_{2i}.dT_{ri}$$

where $T_s$ and $T_{ri}$ represent the intake temperature and the backcooling temperatures following coolers after each turbocompressor and $dT_s$ and $T_{ri}$ and reference temperatures $T_{ref}$. The system automatically compensates for the shift of the pump limit with temperature and allows operation closer to the pump limit or boundary for stable aerodynamic operation.

5 Claims, 4 Drawing Sheets

METHOD OF MONITORING A PUMPING LIMIT OF A MULTISTAGE TURBOCOMPRESSOR WITH INTERMEDIATE COOLING

FIELD OF THE INVENTION

Our present invention relates to a method of monitoring the pumping limit of a multistage turbocompressor, i.e. a turbocompressor cascade, with intermediate or intervening cooling, i.e. cooling between the stages or following each turbocompressor stage. More particularly, the method of the invention relates to the operation of a multistage turbocompressor with postcompression cooling and deals specifically with the problem of potential operation at a pumping limit of the operating graph for the cascade.

BACKGROUND OF THE INVENTION

A turbocompressor cascade comprises a plurality of turbocompressors, i.e. compressor turbines, between which a heat exchanger is provided for the intermediate cooling of the compressed medium, generally a gas, so that the compressed gas passing to the next compressor stage is after cooled. Generally a corresponding heat exchanger is provided following the final stage as well.

The parameters of such a turbocompressor cascade can include the intake side pressure ($p_1$) the discharge side pressure ($p_2$), the intake side temperature or suction temperature $T_s$, the intermediate temperatures (or aftercooling temperatures) following cooling $T_{ri}$, where i represents the stage, i.e. is 1, 2, 3 . . . , n, also referred to as backcooling temperatures, and the volume rate of flow (F) through the system.

The measured values ($p_l$, $p_2$, F, $T_s$, $T_{ri}$) are fed to a control device with a data storage capability, can be compared with values of a compressor characteristic operating graph (i.e. the empirically derived optimum operating characteristics in a form enabling such storage and comparison) so that when the measured values of $p_1$, $p_2$ and F, for example, approach limits of the compressor operating graph, i.e. the so-called pumping limits, a warning signal or controlled signal is provided to prevent continued operation at or beyond these limits or, at least, to alert operating personnel that the limits have been approached.

The reference to a compressor operating graph is intended to include a collection of stored data in any form enabling the comparison of the measured values with corresponding empirically determined conditions of intended operation capable of indicating the approach to the pumping limit. For example, the "graph" can simply be tabulated data or operating tables derived from such data or other parameters automatically calculated by computer from stored data. All of these techniques are known in the art.

The pumping limit is defined as an aerodynamic stability boundary for the operating graph which limits the utility of the turbocompressor. When operation is effected below the pumping limit, refluxing or backflow can occur in the turbocompressor which results in pressure fluctuations, temperature increases and significant increase in the pumping noise.

Operating below these limits or at the pumping limit can lead in very short order to bearing failure and damage to the turbine blades.

To avoid operation of a turbocompressor in an unstable range, i.e. at or below the pumping limit, monitoring and controlled devices are provided which, upon critical approach to or passage of the pumping limit, open blow-off valves to the atmosphere or open a bypass valve in a circulating line which connects the pressure and suction sides of the turbocompressor. In this manner, a minimum flow through the turbocompressor is maintained and operation below the pumping limit is precluded.

Intermediate-cooled turbocompressors should allow control over a wide volume range. Control elements for this purpose can include inlet or outlet guide devices or drives with variable speeds for the turbocompressors. Combinations of these controlled elements can also be provided. However, the full utilization of the entire operating graph of the turbocompressor cascade requires that the pumping limit be determinable with precision.

Conventional processes for monitoring the pump limit of multistage intermediate cooled turbocompressors ignore the influence of changes in the cooling temperature on the pumping limit. The intermediate cooling temperature, constituting the temperature of the gas at the input to each successive stage has been found to play a major role upon the location of the pumping limit in the operating field of the turbocompressor.

In operation of the turbocompressor, variations of the stage input temperatures cannot be avoided and these variations can be a function of soiling of or poorly operating coolers, variations in the flow of the cooling agents through the heat exchangers or the like.

There are also seasonal changes in the intake temperatures of the gases to be compressed.

Ignoring the temperature effect on the location of the pumping limit requires that the turbocompressor be operated within much narrower operating limits with respect to volume variations, since the approach to the actual pumping limit can never be guaranteed entirely. Thus conventional systems of this type operate with limited versatility and with loss of range.

OBJECTS OF THE INVENTION

It is, therefore, the principal object of the present invention to provide a method of monitoring the operation of a turbocompressor with intermediate cooling in which the aforementioned problems are avoided.

A more specific object of the invention is to provide a method of operating a multistage turbocompressor with interstage cooling whereby the effect of the gas temperature at the intake of each stage is considered with respect to the position of the pump limit, so that the apparatus can be operated closer to that limit and thus with a wider range of variability with respect to control of the volume, etc.

Still another object of the invention is to provide an improved turbocompressor system of the aforedescribed type whereby the versatility thereof is enhanced.

SUMMARY OF THE INVENTION

These objects are attained, in accordance with the present invention, by measuring the intake temperature $T_s$ at the intake of the first compressor stage of the turbocompressor as well as each of the cooldown temperatures following the respective heat exchanger following each turbocompressor stage and represented at $T_{ri}$ (where i=1 to the number of cooling stages following respective turbocompressor), feeding the temperature measurement values to the control device and generating temperature differences $dT_s$, $dT_{ri}$ from a predetermined reference temperature $T_{ref}$, determining an operating point of the turbocompressor with respect to a pumping limiting value based upon a pumping limit function $Y=m.F+b$ stored in the controlled unit and which represents a (linear) characteristic of the pumping limit in the compressor operating graph at least in part.

Y represents either the pressure ratio ($P_2/P_1$) between the discharge side pressure $p_2$ and the intake side pressure $p_1$ of the cascade or a pressure difference ($P_2$—$P_1$) between the pressures $p_1$ and $p_2$. The coefficients m and b are linear functions of the intake temperature $T_s$ and the backcooling temperatures $T_{ri}$ and are determined by use of the aforementioned temperature differences $dT_s$ and $dT_{ri}$ based upon the relationships $$m=m_0+m_1.dT_s+\Sigma m_{2i}.dT_{ri}$$

$$b=b_0+b_1.dT_s+\Sigma b_{2i}.dT_{ri}$$

The volume flow rate and measured pressure values ($F_1$, $P_1$, $P_2$) are compared with the pumping limit value and upon passing below a predetermined minimum distance therefrom, trigger a warning or control signal.

For measuring the volume rate of flow in a pipe at a location along the cascade, we may make use of the generally accepted method of determining a pressure differential across a standard aperture, nozzle, diaphragm or venturi port. It will be understood that the volume flow rate can be obtained in terms of the measured pressure and temperatures across the aperture, orifice, diaphragm and the venturi nozzle and that the value of the pressure difference can be used directly as the input to the controlled unit. It should be understood further that different reference temperatures for the intake temperatures and backcooling temperatures can be used with the reference temperatures being selected to be appropriate to the thermodynamic design of the turbocompressor cascade. These may be determined empirically without difficulty as well.

The operating graph or range of parameters for the compressor for different intake and backcooling temperatures including the pump limit can be determined by superimposition of the characteristic curves for the individual stages. The calculation of the turbocompressor graphs is conventional in the art and the pumping limits are approximated by straight lines for all of the calculated cases The parameters $m_o$, $m_1$, $m_2$, $b_o$, $b_l$, $b_2$ are generally calculated by solving systems of linear equations. Changes of the stage intake temperatures ($dT_s$, $dT_{ri}$) primarily effect the coefficient b. That results in a shifting of the pump boundary or limit in the operating field. The temperature effect on the slope of the pump limit function is substantially smaller so that, in many cases, $$m_1=m_2=0$$

and the temperature effect on the slope of the pump limit function is negligible.

If the backcooling temperatures differ only slightly from one another, it is sufficient to provide as the measured value of the backcooling temperature ($T_{ri}$) an arithmetic mean over the compressor stages (i=1, 2 . . . n), the mean temperature being represented at $T_r$ and being utilized to calculate the coefficients m and b. In this case, the functions for calculating the coefficients m and b can be simplified to the following:

$$m=m_0+m_1.\ dT_s+.dT_r$$

$$b=b_0+b_1.\ dT_s+.dT_r$$

In a preferred embodiment of the invention the temperature coefficients $m_1$, $b_1$, $m_{2i}$, $b_{2i}$ or $m_2$, $b_2$, calculated by variation of the intake and backcooling temperatures by the thermodynamic operating field calculations for the compressor cascade, are stored as constants in the control device, while the coefficients $m_0$ and $b_0$ are determined empirically by field tests on the installed turbocompressor cascade and are then inputted to the control computer. The pump limit function can then be determined with great precision and simultaneously calibrated. In order to calibrate the pump limit function, the turbocompressor can be driven briefly at its pump limit and the respective pressure, temperature and volume flow values measured and evaluated by the aforementioned equations the coefficients $m_0$, $b_0$.

More particularly, a method of operating a multistage turbocompressor system in which at an intake temperature $T_s$ and pressure $p_1$ a gas is drawn into a first turbocompressor, gas compressed in the first turbocompressor is subject to intermediate cooling, cooled gas is compressed in subsequent turbocompressors in cascade with subsequent cooling to temperatures $T_{ri}$ where i is a number which represents the number of the cooling stage in succession at which the cooling occurs, and the gas after a last turbocompressor and cooling stage of the cascade has a discharge pressure $p_2$ for a volume rate of flow F through the cascade, the method comprising the steps of:

(a) driving the cascade and measuring the intake temperature $T_s$, each temperature $T_{ri}$, temperature differences $dT_s$ and $dT_{ri}$ of the temperatures $T_s$ and $T_{ri}$ and a predetermined reference temperatures $T_{ref}$, the pressures $p_1$ and $p_2$ and the volume rate of flow F;

(b) calculating a pump operating unit function $Y=m.F+b$ relating the pressures $p_1$ and $p_2$ and the rate of flow F and describing a pump limit in a stored compressor performance graph, where Y is a pressure difference or ratio of the discharge pressure $p_2$ and the intake pressure $p_1$, and m and b are coefficients which are linear functions of the intake temperature $T_s$ and temperatures $T_{ri}$ and the temperature differences $dT_s$, $dT_{ri}$ where;

$$m=m_0+m_1.dT_s+\Sigma m_{2i}.dT_{ri} \text{ and}$$

$$b=b_0+b_1.dT_s+\Sigma b_{2i}.dT_{ri},$$

where $m_0$, $b_0$, $m_1$, $b_1$ and $m_{2i}$, $b_{2i}$ are empirically determined constants;

(c) storing the pump operating limit function;

(d) comparing measured values of the volume rate of flow F and the pressures $p_1$ and $p_2$ of step (a) during driving of said cascade with corresponding values in the compressor storage graph; and (e) generating a warning or control signal upon operation of the cascade with said measured values falling to a predetermined degree below a predetermined distance from the stored pump operating limit function.

The advantage of the invention is that the shifts in the pump limit as a consequence of changes in the intake and backcooling temperatures are automatically taken into consideration and the position of the pump limit at variations of the operating point of the turbocompressor can be determined with precision. The safety factor with respect to the pumping limit at which one operates can be greatly narrowed and the volume control range of multistage intermediate cooled turbocompressor can be more fully utilized. The equipment and systems required for carrying out the invention are not at all costly.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
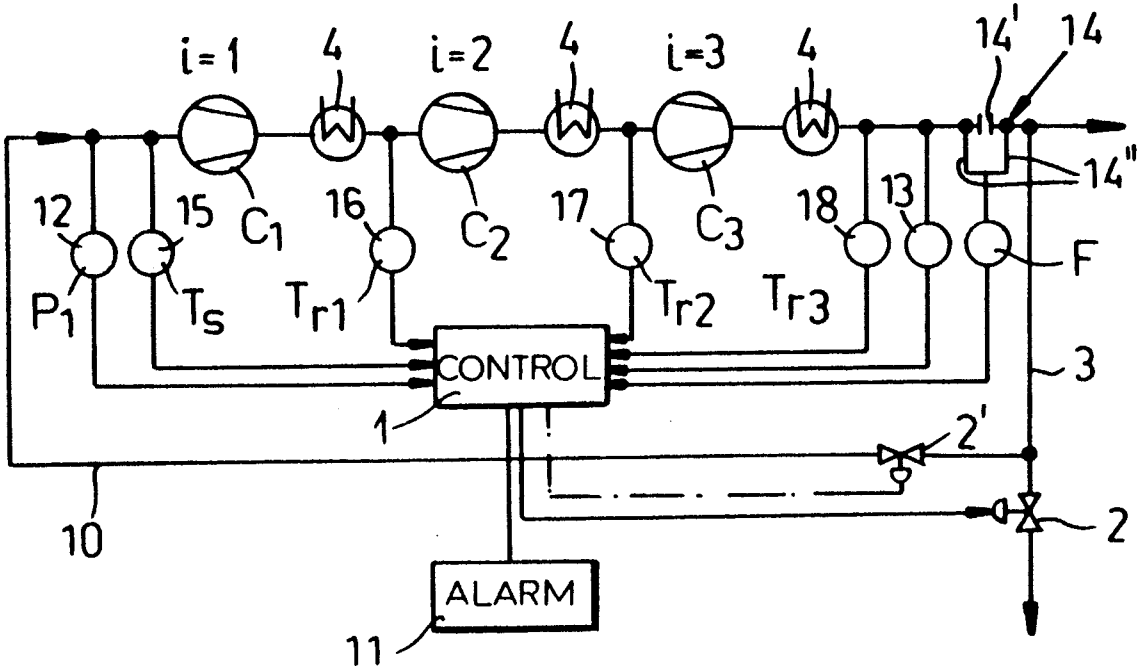
FIG. 1 is a diagrammatic illustration of a turbocompressor cascade embodying the invention.

The turbocompressor shown in FIG. 1 has three turbocompressors $C_1$, $C_2$ and $C_3$ for the three stages $i=1$, $i=2$, $i=3$ of the turbocompressor cascade and is used for the compression, for example, of air or nitrogen although this utility is not exclusive. The turbocompressor may be used ahead of or in conjunction with an air rectification unit for the separation of oxygen or nitrogen or both from air or, for that matter, whenever high degrees of compression may be required.

For each compression stage backcooling is effected, for example, by respective heat exchangers 4 for each stage, the heat exchangers being fed with cooling agents by means not shown and standard in the art.

The turbocompressor cascade has a control unit 1 with the capacity for data storage, e.g. a computer, which serves to monitor the pumping limit and can control a valve 2, which is normally closed and which, upon opening, can vent the system to the atmosphere. Alternatively, the control unit 1 can control a valve 2' connected in a bypass 10 between the pressure side of the compressor and the intake side thereof.

If the operating point of the compressor approaches the pump limit, the control 1 can open one or both of the valves 2, 2' and/or deliver a signal to an alarm 11 capable of warning the operator of the proximity to the pump limit and thus the advent of a potentially dangerous situation.

The turbocompressor cascade is provided with measuring devices 12 and 13 for measuring the intake pressure $p_1$ and the discharge pressure $p_2$ at the intake and discharge sides of the cascade. These measuring devices may be standard manometers or pressure gauges capable of outputting appropriate digital or analog signals representing the pressures to the control computer 1.

The system is also provided with a measuring device 14 for measuring the volume flow F. The latter device may be an orifice signified at 14' and means represented at 14" for determining the pressure differential across that orifice.

In addition, temperature measuring devices 15, 16, 17, 18 are provided for measuring the intake temperature $T_s$ at the intake side of the first compressor stage $m=1$ and the backcooling temperatures $T_{ri}$, namely, $T_{r1}$, $T_{r2}$ and $T_{r3}$ following each compressor turbine. The backcooling temperature is defined as the temperature of the gas stream in the flow direction downstream of the heatexchanger for backcooling the gas after the heating thereof by compression in the respective turbocompressors. All of these values are fed to the control computer 1.

The control computer 1 stores a pump limit function $Y=m.F+b$ which describes the substantially linear characteristic of the pump limit in the operating graph of the turbocompressor either entirely or in part.

The value Y corresponds to the pressure difference or the pressure ratio between the discharge side pressure $p_2$ of the turbo compressor cascade and the intake side pressure $p_l$ thereof.

The coefficients m and b are linear functions of the intake temperatures $T_s$ and the backcooling temperature $T_{ri}$ and are determined by the relationships $$m=m_0+m_1.(T_s-T_{ref})+\Sigma m_{2i}.(T_{ri}-T_{refi})$$

$$b=b_0+b_1.(T_s-T_{ref})+\Sigma b_{2i}.(T_{ri}-T_{refi})$$

In these relationships $T_{ref}$ and $T_{refi}$ are freely selectable reference temperatures. Most advantageously, however, the reference temperatures are predetermined design temperatures for the turbocompressor, established in the design of the turbocompressor from the expected thermodynamic characteristic thereof.

The operating graph of the compressor for different intake and backcooling temperatures, including the corresponding pumping limits, can be theoretically determined by superimposition of the individual stage characteristic or graphs. The pumping limits can be approximated by straight lines for all calculated cases and stored in the memory of the computer. The parameters $m_0$, $m_1$, $m_{2i}$, $b_0$, $b_1$, $b_{2i}$ are determined by solving linear equation systems.

Figure 2:
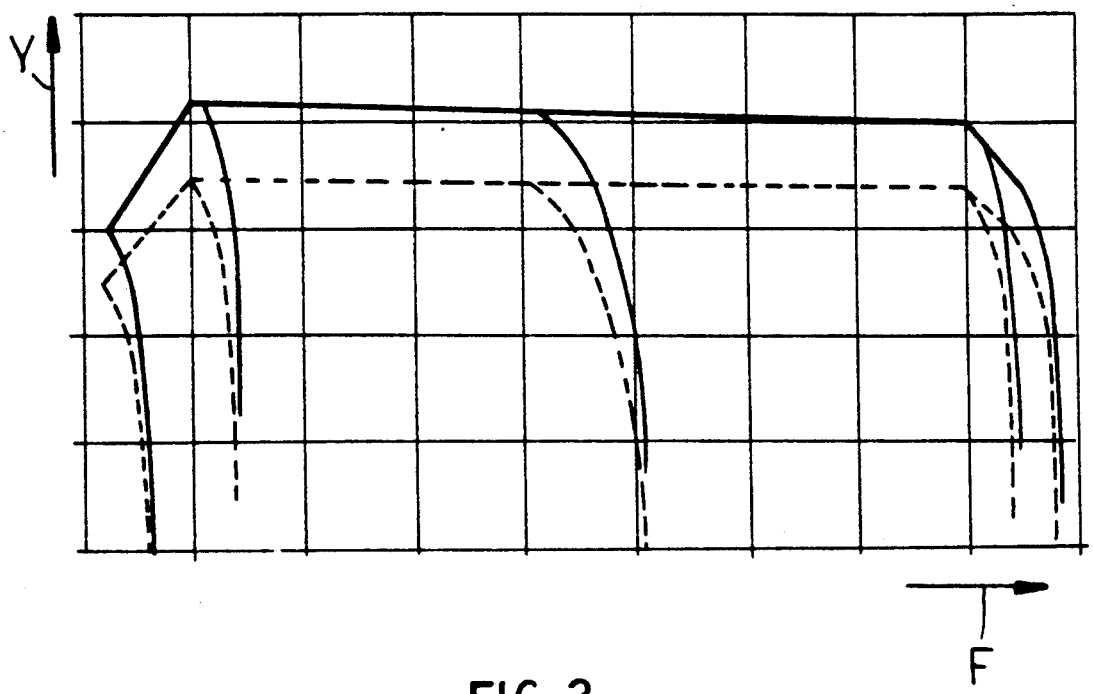
FIGS. 2 and 3 are graphs in which Y, the pressure difference or ratio as described above, and F being plotted respectively along the ordinate and the abscissa.
Figure 3:
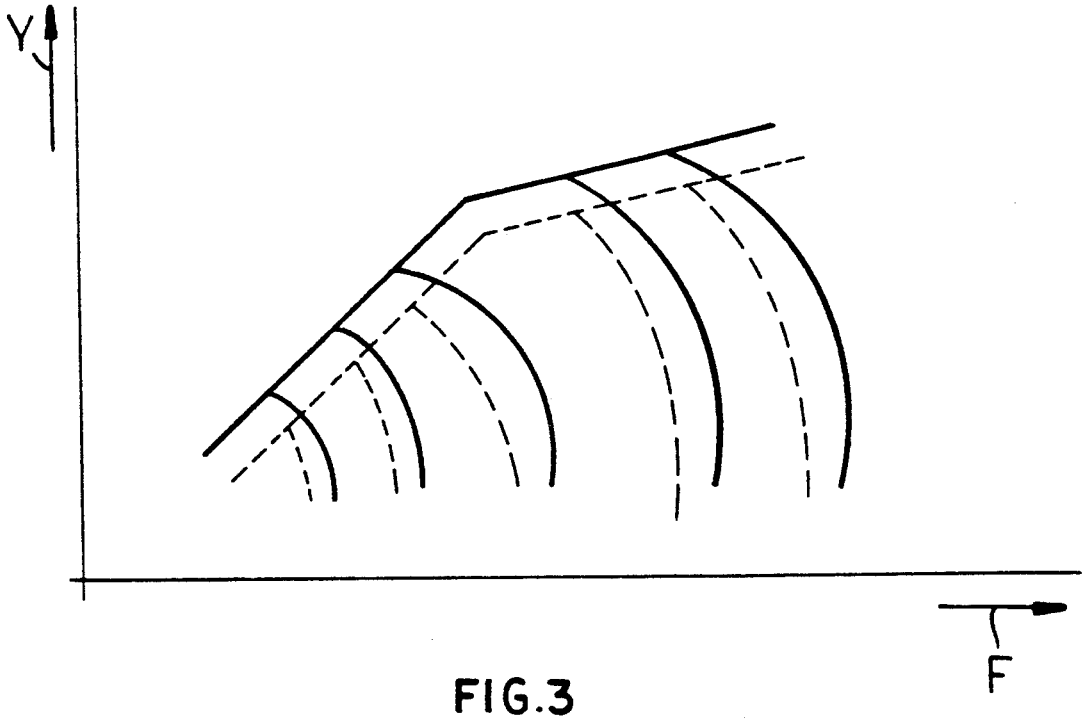

The graphs characterizing the turbocompressor operation and illustrated in FIGS. 2 and 3 show general cases in which the characteristic of the pump limit is at least in part a linear graph representing the pump limit function $Y=m.F+b$ or which is approximated by the linear pump limit function $Y=m.F+b$. Changes in the intake and backcooling temperatures result in shifting of the pump limit as can be seen from a comparison of the broken and solid line positions in FIGS. 2 and 3.

Figure 4:
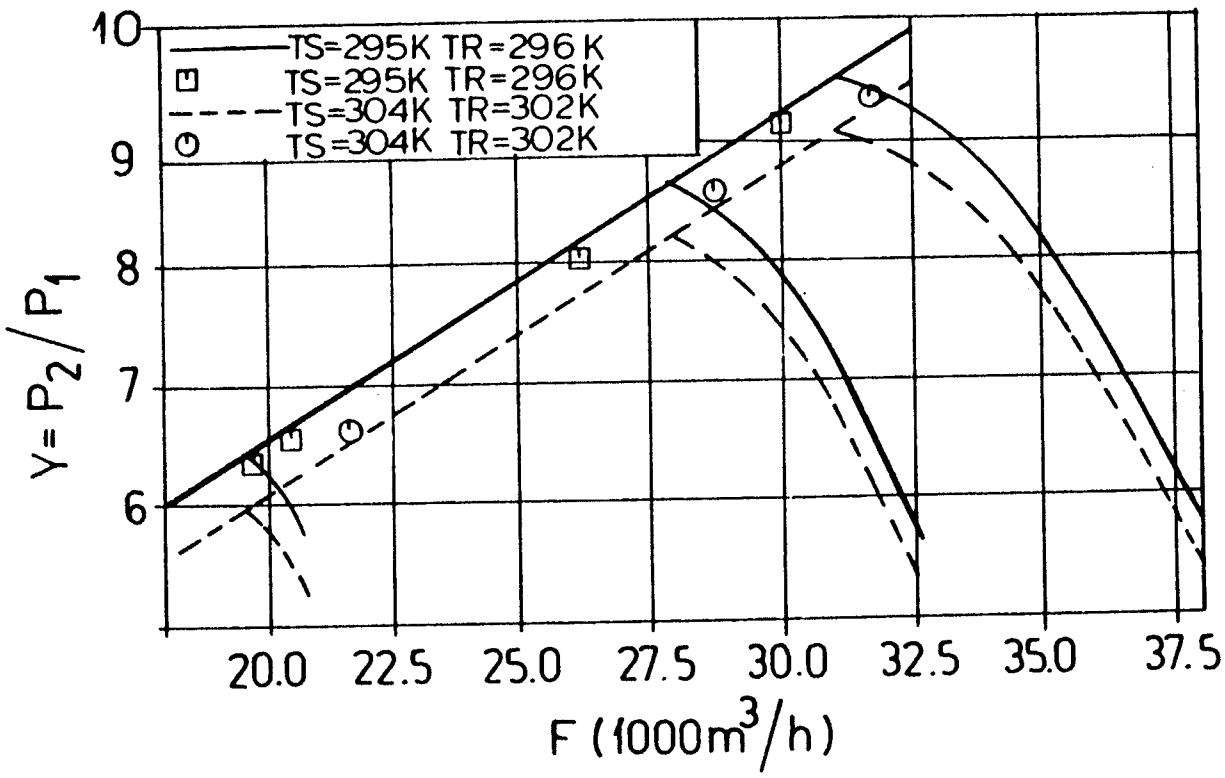
FIGS. 4 and 5 are turbocompressor operating graphs showing appropriate values for a mean backcooling temperature $T_r$ and intake temperature $T_s$ for various values of Y, plotted along the ordinate, and F plotted along the abscissa and representing assemblies of how the invention can be carried out in practice, illustrating a calculated pumping limit on the one hand and a pumping limit determined by field tests in the manner described on the other hand.
Figure 5:
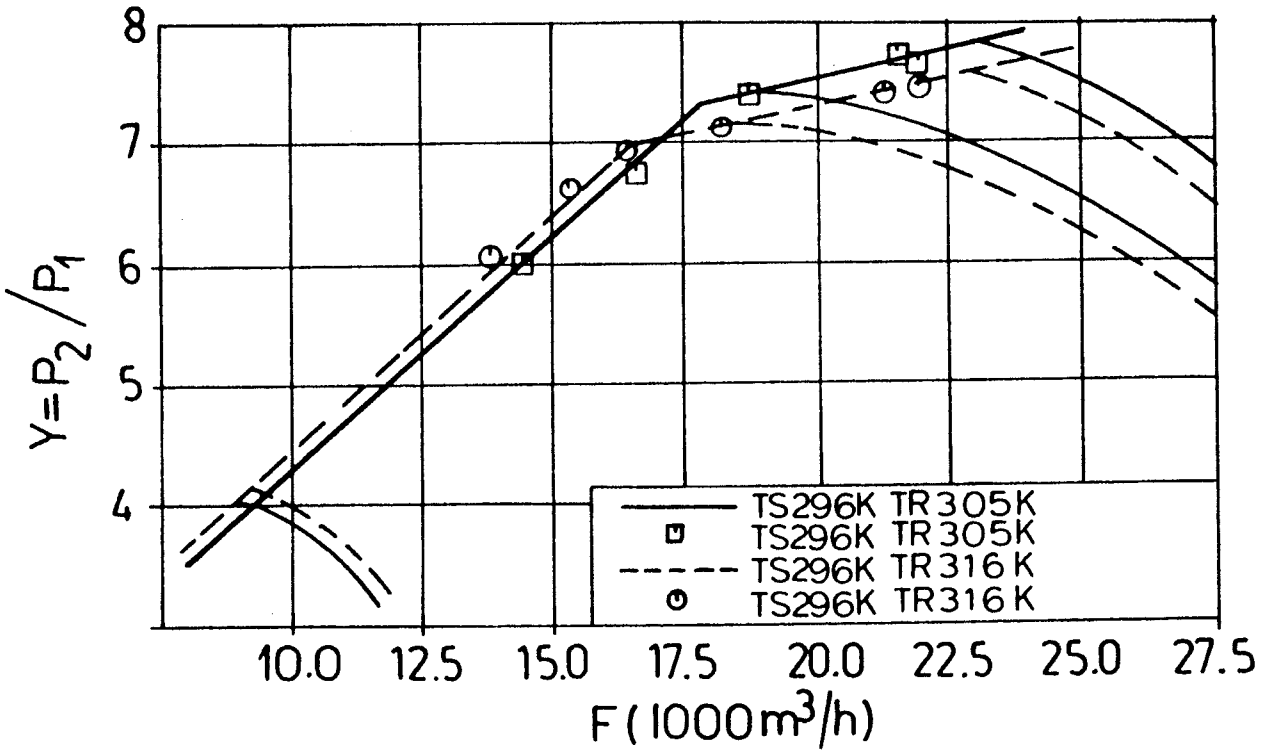

FIGS. 4 and 5 illustrate the operating fields of two three-stage turbocompressors having at the intake side a control device regulating flow to the turbocompressor and serving as a volume control element for adjusting the operation of a range of volumes. The graph of the pump limit is completely approximated by the pump limit function (FIG. 4) or is approximated by the pump limit function over a portion of the graph (FIG. 5).

A comparison of the solid and broken line showings will demonstrate the temperature effect on the pump limit. In these graphs, moreover, values have been illustrated for the pump limit which were determined in field tests of the turbocompressors.

The comparison makes clear that the pump limit function stored in the control computer 1 defines the actual graph of the pump limit with great precision even with temperature variations of the gas stream and hence one can operate very close to the limit before the warning signal is triggered or the valves are opened. According to the pump limit function stored in the control device, an operating point of the turbo compressor can be determined by the measured pressure values $p_1$, $p_2$ or the measured volume value F as well as the measured temperature values $T_s$ and $T_{ri}$. The measured values of the volume F and the pressures $p_1$ and $p_2$ are compared with this pumping limit and, upon falling below a predetermined minimum value of a distance from the pumping limit a warning signal or control signal for opening the valve 2 can be triggered. This minimum value can be a value representing the precision of the pumping limit as determined statistically.

We claim:

1. A method of operating a multistage turbocompressor system in which at an intake temperature $T_s$ and pressure $p_1$ a gas is drawn into a first turbocompressor, gas compressed in the first turbocompressor is subject to intermediate cooling, cooled gas is compressed in subsequent turbocompressors in cascade with subsequent cooling to temperatures $T_{ri}$ where i is a number which represents the number of the cooling stage in succession at which said cooling occurs, and the gas after a last turbocompressor and cooling stage of the cascade has a discharge pressure $p_2$ for a volume rate of flow F through the cascade, said method comprising the steps of:

(a) driving said cascade and measuring said intake temperature $T_s$, each temperature $T_{ri}$, temperature differences dTs and $dT_{ri}$ of the temperatures $T_s$ and $T_{ri}$ and a predetermined reference temperatures Tref, the pressures $p_1$ and $p_2$ and the volume rate of flow F;

(b) describing a pump limit function $Y=m.F+b$ relating said pressures $p_1$ and $p_2$ and said rate of flow F in a stored compressor performance graph, where Y is selected from one of a pressure difference and a ratio of the discharge pressure $p_2$ and the intake pressure $p_1$, and m and b are coefficients which are linear functions of the intake temperature $T_s$ and temperatures $T_{ri}$ and the temperature differences dTs, $dT_{ri}$ where:

$$m=m_0+m_1.dT_s+\Sigma m_{2i}.dT_{ri} \text{ and}$$

$$b=b_0+b_1.dT_s+\Sigma b_{2i}.dT_{ri}$$

where $m_0$ and, $b_0$ are empirically determined constants and temperature coefficients $m_1$, b1, m2i, $b2_i$ are determined by thermodynamic calculations with variations of the intake and cooling temperatures and are stored in a control unit;

(c) operating the turbocompressor cascade at its pumping limit for the purpose of calibrating the pump limit function to yield pressure, temperature and volume values from which the coefficients $m_0$, $b_0$ for the pump limit function are determined and providing the coefficients $m_0$, $b_0$ as inputs to the control unit;

d storing said pump limit function;

e comparing measured values of the volume rate of flow F and the pressures $p_1$ and $p_2$ of step (a) during driving of said cascade with corresponding values in said compressor storage graph; and f generating a control signal upon operation of said cascade with said measured values falling below a predetermined minimum value of a distance from said stored pump limit function.

2. The process defined in claim 1 wherein a warning signal is generated in step (f) to alert an operator to the passage of the measured values to a predetermined degree below said predetermined distance from said stored pump limit function.

3. The process defined in claim 1 wherein, in step (f), a vent valve at a discharge side of said cascade is opened.

4. The process defined in claim 1, further comprising opening a bypass valve connecting a discharge side of said cascade with an intake side thereof upon said measured values falling in step (f) to a predetermined degree below said pre determined distance from said stored pump operating limit value.

5. The process defined in claim 1 wherein an arithmetic mean is formed from said temperatures $T_{ri}$ and the arithmetic mean is used to calculate the coefficients m and b.

* * * * *